US010555618B2

(12) United States Patent
Pearce

(10) Patent No.: US 10,555,618 B2
(45) Date of Patent: Feb. 11, 2020

(54) MATTRESS PROTECTORS, MATTRESSES COVERED BY MATTRESS PROTECTORS, AND RELATED METHODS

(71) Applicant: Purple Innovation, LLC, Alpine, UT (US)

(72) Inventor: Tony M. Pearce, Alpine, UT (US)

(73) Assignee: Purple Innovation, LLC, Alpine, UT (US)

( * ) Notice: Subject to any disclaimer, the term of this patent is extended or adjusted under 35 U.S.C. 154(b) by 543 days.

(21) Appl. No.: 15/272,162

(22) Filed: Sep. 21, 2016

(65) Prior Publication Data

US 2018/0078048 A1 Mar. 22, 2018

(51) Int. Cl.
*A47C 31/10* (2006.01)
*A47C 27/00* (2006.01)
(Continued)

(52) U.S. Cl.
CPC ..... *A47C 31/105* (2013.01); *A47C 7/02* (2013.01); *A47C 27/00* (2013.01); *A47C 27/12* (2013.01);
(Continued)

(58) Field of Classification Search
CPC ..... A47C 21/02; A47C 21/022; A47C 21/026; A47C 21/028; A47C 31/00; A47C 31/004;
(Continued)

(56) References Cited

U.S. PATENT DOCUMENTS 4,369,284 A * 1/1983 Chen ..... A61C 15/041 44/271
5,603,132 A * 2/1997 Zafiroglu ..... A47G 9/0246 5/497
(Continued)

FOREIGN PATENT DOCUMENTS

WO 9838896 A1 1/2001

OTHER PUBLICATIONS

International Search Report for PCT Application No. PCT/US2017/052462 dated Dec. 13, 2017, four pages.
(Continued)

*Primary Examiner* — Robert G Santos
*Assistant Examiner* — Rahib T Zaman
(74) *Attorney, Agent, or Firm* — Durham Jones & Pinegar, P.C., Intellectual Property Law Group

(57) ABSTRACT

A mattress protector includes a composite sheet having a non-deformed length and a non-deformed width. The composite sheet includes a fabric and a water impermeable polymer. The composite sheet is capable of repeatedly stretching to a deformed length of at least 115% of the non-deformed length and returning to within 8% of the non-deformed length without rupture or permanent wrinkling of the composite sheet. Mattresses may be covered and protected by such a mattress protector. Methods of forming mattress protectors include providing a water impermeable polymer on a fabric so as to form a composite sheet having a non-deformed length and a non-deformed width, and formulating and configuring the composite sheet so as to be capable of repeatedly stretching to a deformed length of at least 115% of the non-deformed length and returning to within 8% of the non-deformed length without rupture or permanent wrinkling of the composite sheet.

20 Claims, 4 Drawing Sheets

(51) Int. Cl.

| | |
|---|---|
| ***A47G 9/04*** | (2006.01) |
| ***A47C 27/12*** | (2006.01) |
| ***A47C 31/00*** | (2006.01) |
| ***A47G 9/00*** | (2006.01) |
| ***A47C 7/02*** | (2006.01) |

(52) U.S. Cl.
CPC ..... *A47C 31/00* (2013.01); *A47G 9/00* (2013.01); *A47G 9/04* (2013.01)

(58) Field of Classification Search
CPC .. A47C 31/105; A47C 27/008; A47G 9/0238; A47G 9/0246; A47G 9/0261
See application file for complete search history.

(56) References Cited

U.S. PATENT DOCUMENTS

| | | | | | |
|---|---|---|---|---|---|
| 5,749,111 | A * | 5/1998 | Pearce | A43B 13/04 | 428/137 |
| 5,994,450 | A * | 11/1999 | Pearce | A43B 13/04 | 524/505 |
| 6,026,527 | A | 2/2000 | Pearce | | |
| 6,413,458 | B1 | 7/2002 | Pearce | | |
| 6,845,532 | B1 * | 1/2005 | Rosenblum | A47C 27/008 | 40/661 |
| 7,047,580 | B2 | 5/2006 | Finn | | |
| 7,964,664 | B2 * | 6/2011 | Pearce | C08F 297/04 | 5/652 |
| 8,347,430 | B2 | 1/2013 | Malouf et al. | | |
| 8,919,750 | B2 * | 12/2014 | Pearce | A47C 7/02 | 267/153 |
| 9,345,337 | B1 * | 5/2016 | Chai | A47C 27/005 | |
| 2005/0177942 | A1 * | 8/2005 | Finn | A47C 27/005 | 5/499 |
| 2007/0174962 | A1 * | 8/2007 | Smith | A47C 27/006 | 5/484 |
| 2008/0202665 | A1 * | 8/2008 | Seago | A47G 9/0246 | 156/84 |
| 2011/0010865 | A1 * | 1/2011 | Flick | A47C 7/021 | 5/690 |
| 2012/0167302 | A1 * | 7/2012 | Malouf | A47C 31/007 | 5/484 |
| 2012/0255120 | A1 * | 10/2012 | Poston | A47C 31/105 | 5/499 |
| 2013/0097904 | A1 * | 4/2013 | Wright, Jr. | G09F 13/02 | 40/559 |
| 2014/0215870 | A1 * | 8/2014 | Horst | A47C 31/105 | 40/299.01 |
| 2014/0248481 | A1 * | 9/2014 | Curos Santaeularia | B32B 5/04 | 428/219 |
| 2015/0216332 | A1 * | 8/2015 | Clay | A47C 31/105 | 5/636 |
| 2016/0128499 | A1 * | 5/2016 | Jhou | A47G 9/0292 | 5/493 |

OTHER PUBLICATIONS

Written Opinion of the International Search Authority for PCT Application No. PCT/US2017/052462 dated Dec. 13, 2017, 11 pages.

Bed Bath & Beyond, Mattress Protectors, http:l/www.bedbathandbeyond.com/store/s/mattress-protectors/4294966331-4294967217-13619/1-48?&view=grid&_dyncharset=UTF-8&isFromSWD=false, visited Sep. 14, 2016, 7 pages.

Bedgear, 3.0 StretchWick Performance Mattress Protector—Bedgear Performance Bedding, http://www.bedgear.com/shop/stretchwick-waterproof-mattress-protector.html, visited Sep. 14, 2016, 3 pages.

Luna , Mattress Protector, Queen Size Luna Premium Hypoallergenic 100% Waterproof Mattress Protector, Amazon.com, visited Sep. 14, 2016, 8 pages.

Protect a Bed, Premium Mattress Protectors, http://protectabed.factoryoutletstore.com/details/108446/protect-a-bed-premium-mattress-protector-king.html, visited Sep. 14, 2016, 2 pages.

Suregaurd, Mattress Protector, Queen Size SureGuard Mattress Protector—100% Waterproof, Hypoallergenic Premium Fitted Cotton Terry Cover, Amazon.com, visited Sep. 14, 2016, 8 pages.

Target, Room Essentials, Waterporoof Mattress Pad (Queen), http://www.target.com/s?searchTerm=room%20essentials%2C%20waterproof%20mattress%20pad#sn-50585482, visited Sep. 14, 2016, 4 pages.

Taiwan Office Action for Taiwan Application No. 106132217, dated Aug. 13, 2018, 13 pages with English Translation.

* cited by examiner

MATTRESS PROTECTORS, MATTRESSES COVERED BY MATTRESS PROTECTORS, AND RELATED METHODS

FIELD

Embodiments of the disclosure relate generally to mattress protectors for protecting a mattress from fluids, dust, bugs, mold, and other matter, mattresses covered by such mattress protectors, and related methods.

BACKGROUND

Mattress protectors are commonly used to cover or encase a mattress or other cushion so as to protect the mattress or cushion from liquid spills, dust, dirt, bugs, and other matter. Mattress protectors protect the person resting on the mattress from materials that might be present in the mattress.

Mattress protectors commonly include a fabric coated with, or laminated to a layer of thermoplastic polyurethane material. The layer of thermoplastic polyurethane prevents liquid from penetrating into the mattress, preferably while allowing gas and vapor transmission through the mattress protector. The mattress protector also prevents transmission of allergens, mites, bed bugs, and other insects. The layer of thermoplastic polyurethane protects the mattress from staining, soiling, and soaking, while also protecting a person resting on the mattress from allergens, mites and bed bugs that may reside within the mattress. The layer of thermoplastic polyurethane may also assist in preventing allergens, mites, and bed bugs from entering the mattress in the first place.

Commercially available mattress protectors, however, tend to be relatively inelastic and non-stretchable, as the thermoplastic polyurethane layer is relatively stiff and resistant to stretching. In addition, the fibers commonly employed in the fabric layer are also not substantially elastic.

The present inventor has discovered that, while the prior non-stretch or low-stretch mattress protectors are adequate for traditional firm spring mattresses, easy and substantive stretchability is important for modern mattresses (such as mattresses based on memory foam, latex, air bladders, or buckling hollow-column gel material), which tend to be more deformable so as to allow the mattress to better conform to the shape of the body of a person resting upon the mattress. When a non-stretch or low stretch mattress protector is used with such a mattress, the mattress protector may hinder or prevent the mattress from fully deforming and conforming to the shape of the body of a person resting upon the mattress, thus creating higher pressure and discomfort on the body of the person.

BRIEF SUMMARY

In some embodiments, the present disclosure includes a mattress protector comprising a composite sheet having a non-deformed length and a non-deformed width. The composite sheet includes a fabric and a water impermeable polymer carried by the fabric. The composite sheet is capable of repeatedly stretching to a deformed length of at least 115% of the non-deformed length and returning to within 8% of the non-deformed length without rupture or permanent wrinkling of the composite sheet.

In additional embodiments, the present disclosure includes an assembly comprising a mattress and a mattress protector covering at least one surface of the mattress. The mattress protector comprises a composite sheet having a non-deformed length and a non-deformed width. The composite sheet includes a fabric and a water impermeable polymer carried by the fabric. The composite sheet is capable of repeatedly stretching to a deformed length of at least 115% of the non-deformed length and returning to within 8% of the non-deformed length without rupture or permanent wrinkling of the composite sheet.

In yet further embodiments, the present disclosure includes methods of forming a mattress protector. In accordance with such methods, a fabric is provided, and a water impermeable polymer is provided on the fabric so as to form a composite sheet having a non-deformed length and a non-deformed width. The composite sheet is formulated and configured so as to be capable of repeatedly stretching to a deformed length of at least 115% of the non-deformed length and returning to within 8% of the non-deformed length without rupture or permanent wrinkling of the composite sheet.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular mattress cover, mattress, material, or product, but are merely idealized representations employed to describe embodiments of the present disclosure. Elements common between figures may retain the same numerical designation.

Embodiments of the present disclosure include mattress protectors that are, relatively to known mattress protectors, more distortable and highly conformable.

Figure 1:
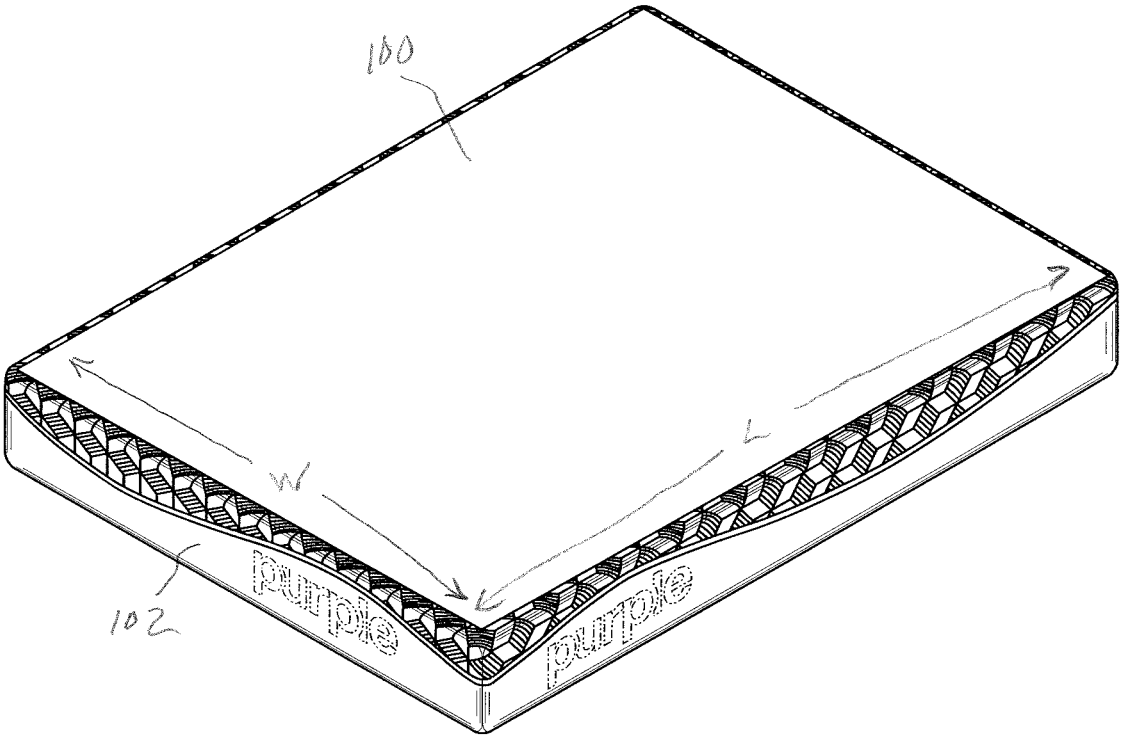
FIG. 1 is a perspective view of an embodiment of a mattress protector of the present disclosure disposed on a mattress.

FIG. 1 illustrates an embodiment of a mattress protector 100 of the present disclosure disposed on a mattress 102. The mattress protector 100 of FIG. 1 is sized and configured to rest upon and cover only an upper surface of a mattress 102. The mattress protector 100 is, thus, planar when properly positioned on the mattress 102. The mattress protector is rectangular, and has a non-deformed length L and width W.

The non-deformed length and the width may be substantially equal to, respectively, standard length and width dimensions for standard sized commercial mattresses. For example, a twin sized mattress protector 100 may have a length of between about 72 and 76 inches, and a width of between about 37 and 41 inches. A twin xl sized mattress protector 100 may have a length of between about 78 and about 82 inches, and a width of between about 37 and about 41 inches. A full sized mattress protector 100 may have a length of between about 72 and about 76 inches, and a width of between about 52 and about 56 inches. A full xl sized mattress protector 100 may have a length of between about 78 and about 82 inches, and a width of between about 52 and about 56 inches. A queen sized mattress protector 100 may have a length of between about 78 and about 82 inches, and a width of between about 58 inches and about 62 inches. A king sized mattress protector 100 may have a length of between about 78 and about 82 inches, and a width of between about 74 inches and about 78 inches. A California king sized mattress protector 100 may have a length of between about 82 and about 86 inches, and a width of between about 70 inches and about 74 inches.

Figure 2:
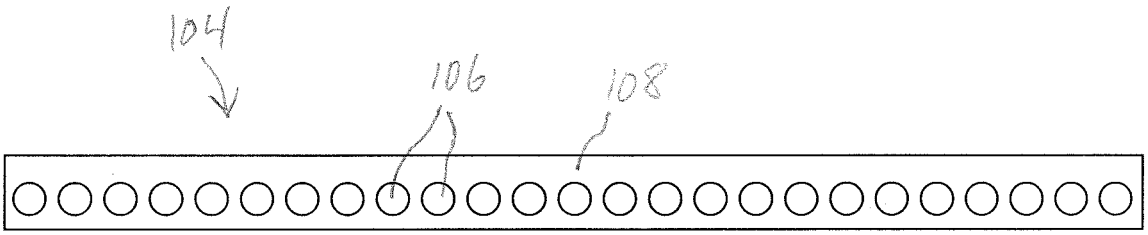
FIG. 2 is a simplified and schematically illustrated cross-sectional side view of an embodiment of a composite sheet of the mattress protector of FIG. 1.

The mattress protector 100 consists essentially of a sheet of composite material 104, which is illustrated schematically in FIG. 2. As shown in FIG. 2, the sheet of composite material 104 includes a fabric 106 and a layer of polymer material 108 carried by the fabric 106. As discussed in further detail below, the fabric 106 has a high content of elastomeric fibers such that it can be highly distorted and then return to original shape when the distorting force is removed. The layer of polymer material 108 is relatively thin, and is also stretchable. The layer of polymer material 108 is impermeable to water and other liquids so as to prevent transmission thereof through the mattress protector 100.

The sheet of composite material 104 is capable of repeatedly stretching (for example, two hundred times or more) to a deformed length of at least 115% of the non-deformed length and returning to within 8% of the non-deformed length (after each cycle) without rupture or permanent wrinkling of the composite sheet. In some embodiments, the composite sheet is capable of such repeated stretching and relaxation without rupture or permanent wrinkling responsive to a tensile force less than six pounds per linear inch. In yet further embodiments, the composite sheet is capable of repeatedly stretching to a deformed length of at least 125% of the non-deformed length and returning to within 8% of the non-deformed length, without rupture or permanent wrinkling of the composite sheet, responsive to a tensile force less than five pounds per linear inch.

Figure 3:
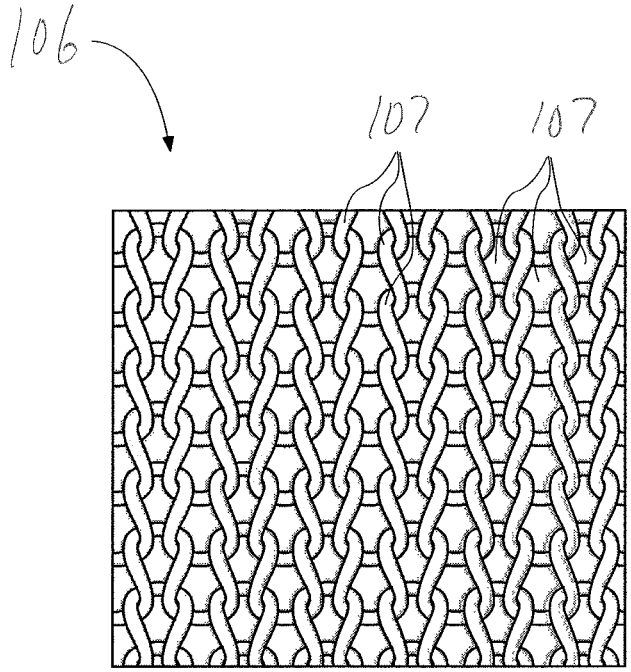
FIG. 3 is a simplified and schematically illustrated drawing of a knit fabric of the composite sheet of FIG. 2.

Referring to FIG. 3, the fabric 106 may comprise a knitted fabric in some embodiments. For example, the fabric 106 may be circular-knitted or warp-knitted (such as terry cloth). The knitting of the fabric 106 allows the fabric 106 to be relatively more stretchable relative to woven fabrics. The knitted fabric 106 may comprise fiber yarn or thread 110 that has been knit to form the knitted fabric 106.

As previously mentioned, the fabric 106 may have a high content of elastomeric fibers relative to commercially available mattress protectors. For example, the fabric 106 may comprise at least 4% by weight, at least 10% by weight, or even at least 15% elastomeric fibers by weight of the fabric 106. As a non-limiting example, the elastomeric fibers may comprise spandex (polyester-polyurethane copolymer, also referred to in the industry as "Lycra" or "elastane").

The fabric 106 may include additional non-elastomeric fibers, such as polyester, cotton, rayon (which may be derived from bamboo, for example), or any other suitable synthetic or natural fibers.

For example, the fabric 106 may include between about 10% and about 20% by weight spandex and between about 80% and about 90% by weight polyester. As one particular non-limiting example, the fabric 106 may include about 15% by weight spandex, and about 85% by weight polyester. Such a fabric may be relatively inexpensive and strong, and sufficiently stretchable, even when combined with a layer of polymer material 108 as described hereinbelow.

The layer of polymer material 108 has a composition and thickness selected such that it will exhibit the desired barrier properties, be sufficiently stretchable as described hereinabove, and be relatively quiet when distorted. As a person resting upon the mattress 102 over the mattress protector 100 adjusts position, the mattress protector 100 generates little noise. Thus, the mattress protector 100 is quieter than commercially available mattress protectors, which typically include a layer of thermoplastic polyurethane having a thickness of 0.002 inches or more. The noise generated upon deformation is primarily a function of the modulus of elasticity of the thermoplastic polyurethane and the thickness of the layer of thermoplastic polyurethane.

In some embodiments, the layer of polymer material 108 may comprise a layer of thermoplastic polyurethane. Any other elastic or visco-elastic polymer materials that prevent water and other liquid transmission may be used in accordance with embodiments of the present disclosure. The layer of polymer material 108, while being impermeable to water and other liquids, may be somewhat breathable to gas and/or vapor, which may provide increased comfort to the user.

The layer of polymer material 108 may have an average layer thickness of about 0.0015 inches or less, or even about 0.001 or less. In addition to being relatively thin, a relatively stretchable (lower tensile modulus) polymer material 108 may be employed. By way of example and not limitation, the layer of polymer material 108 may exhibit an average fabric stretch percent in the long direction (along the length L of the mattress protector) of about 50% or more, about 55% or more, or even about 60% or more, and an average fabric stretch percent in the short direction (along the width L of the mattress protector) of about 25% or more, about 30% or more, or even about 35% or more, when tested according to ASTM D2594-04 R2012 with a ten pound applied weight. Additionally, the layer of polymer material 108 may exhibit an average fabric growth percent in the long direction (along the length L of the mattress protector) of about 10% or less, about 7.5% or less, or even about 6% or less, and an average fabric growth percent in the short direction (along the width L of the mattress protector) of about 15% or less, about 12.5% or less, or even about 11% or less, when tested according to ASTM D2594-04 R2012 with a sixty second recovery period. When tested after a one hour recovery period according to ASTM D2594-04 R2012, the layer of polymer material 108 may exhibit an average fabric growth percent in the long direction of about 5% or less, about 3.5% or less, or even about 2.5% or less, and an average fabric growth percent in the short direction of about 10% or less, about 8% or less, or even about 7% or less.

Figure 4:
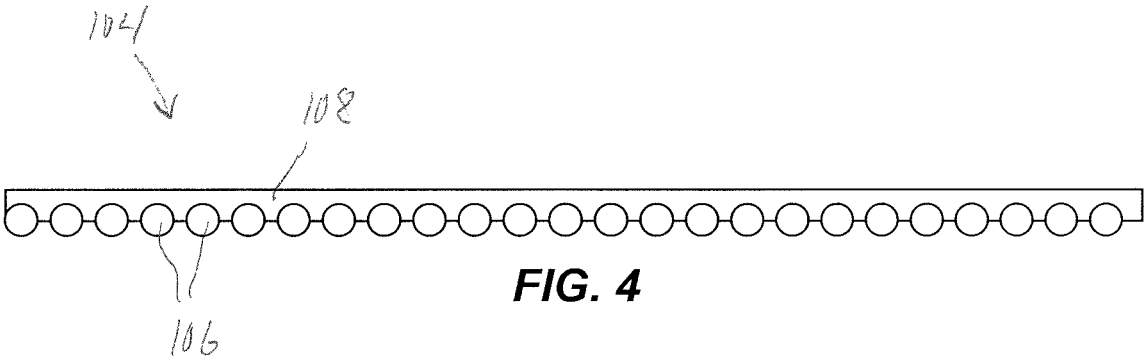
FIG. 4 is a simplified and schematically illustrated cross-sectional side view of another embodiment of a composite sheet of the mattress protector of FIG. 1.

Returning to FIG. 2, in the embodiment shown therein, the fabric 106 may be substantially embedded within the layer of polymer material 108. Referring to FIG. 4, in other embodiments, the layer of polymer material 108 may be disposed primarily on one side of the fabric 106, such that the fabric is at least partially exposed on one side thereof. The layer of polymer material 108 may be formed on the fabric using a deposition process, such as a thermal spray deposition process. In other embodiments, the layer of polymer material 108 may be formed separate from the fabric 106, and then laminated to the fabric 106 by applying heat and pressure to bond the layer of polymer material 108 to the fabric 106. Other processes may be used such as calendering or screeding.

The sheet of composite material 104 is highly conformable in that, due to the stretchiness of the composite material 104, and due to the thinness and/or low tensile modulus of elasticity of the layer of polymer material 108, a body resting upon the mattress 102 with the mattress protector 100 therein can sink into the mattress globally or locally without substantial bridging or fabric tensile stress arising in the sheet of composite material 104, which would hinder or prevent the resting body from sinking into the mattress 102, and, hence, prevent the mattress 102 from fully conforming to the natural shape of the resting body, and/or give rise to increased pressure on the resting body.

Figure 5:
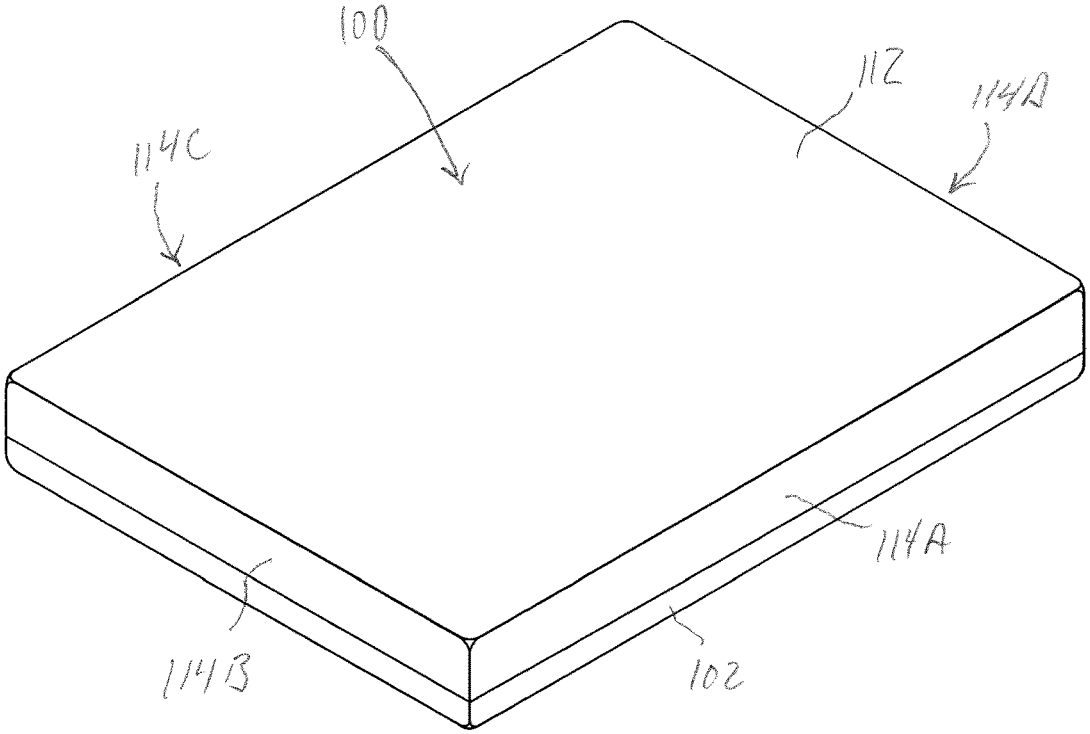
FIG. 5 is a perspective view of another embodiment of a mattress protector of the present disclosure disposed on a mattress, in which the mattress protector includes a top portion and four side portions.
Figure 6:
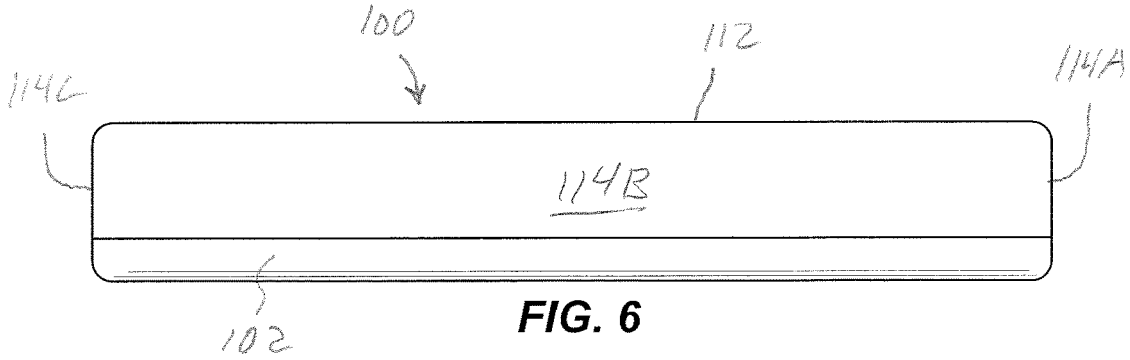
FIG. 6 is a side view of the mattress protector of FIG. 5 disposed on a mattress.

In other embodiments, the mattress protector 100 may take the form of a fitted sheet, as illustrated in FIGS. 5 and 6. In such embodiments, the mattress protector 100 includes a rectangular top portion 112 and four rectangular side portions 114A-114D. Opposing side ends of each rectangular side portion 114A-114D may be sewn or otherwise adjoined to side ends of two adjacent rectangular side portions 114A-114D. At least the top portion 112 comprises the sheet of composite material 104 as described herein; although the side portions 114A-114D may also comprise such a composite material 104 so as to protect the sides of the mattress 102. The mattress protector 100 of FIGS. 5 and 6 may further include an elastic member extending along a lower end of each of the four rectangular side portions 114A-114D to firmly secure the mattress protector 100 in place on the mattress 102. The elastic member may be secured within a hem at the lower end of each of the four rectangular side portions 114A-114D, and may extend entirely around the lower edge of the mattress protector 100. In other embodiments, elastic members may be sewn around only the corners of the mattress protector 100 at the bottom edges of the four rectangular side portions 114A-114D, such that the elastic members extend around only the corner portions of the mattress protector 100.

In the embodiment of FIGS. 5 and 6, the mattress protector 100 comprises a single continuous sheet of the composite material 104, which is sewn only at the corners and hemmed at the free peripheral edges of the sheet of composite material 104.

Figure 7:
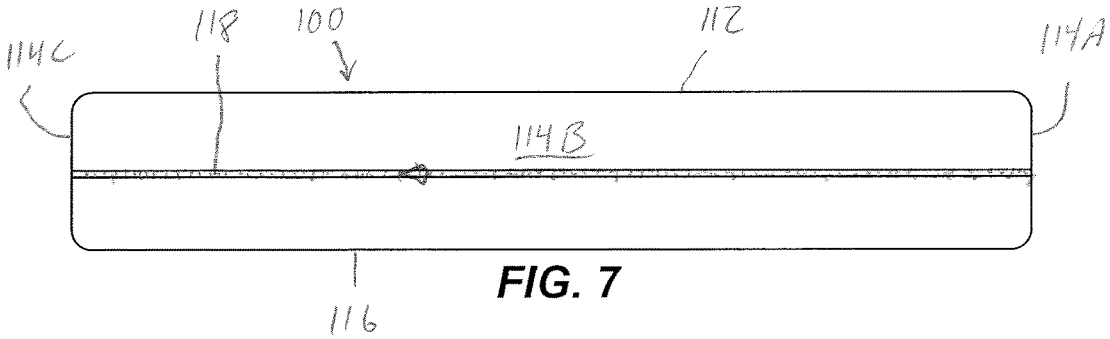
FIG. 7 is a side view like that of FIG. 6 and illustrates another embodiment of a mattress protector of the present disclosure enclosing a mattress, in which the mattress protector includes a top portion, a bottom portion, and four side portions.

Referring to FIG. 7, in yet further embodiments, the mattress protector 100 may be configured to substantially entirely encase a mattress 102. In such embodiments, the mattress protector 100 may have the shape of a rectangular prism when disposed on a mattress 102, and may include a rectangular top portion 112, a rectangular bottom portion 116, and four rectangular side portions 114A-114D (only 114A-114C are visible in FIG. 7). At least the top portion 112 comprises the sheet of composite material 104 as described herein; although the side portions 114A-114D and/or the bottom portion 116 also may comprise such a composite material 104 so as to protect the sides and/or bottom of the mattress 102. The mattress protector 100 in such embodiments may further include an openable and closable aperture through which a mattress 102 may be inserted into the mattress protector 100. A fastening member 118, such as a zipper or hook-and-loop material, may be used for fastening the aperture closed. For example, a zipper may extend in a horizontal direction across one or more of the side portions 114A-114D at least partially around the mattress protector 100. When the zipper is unzipped, a mattress 102 may be inserted into the interior of the mattress protector, after which the zipper may be closed to encase the mattress 102 within the mattress protector 100.

A sheet of composite material 104 as described herein and including a knit fabric 106 comprising 15% by weight spandex and 85% by weight polyester, and a polymer material 108 comprising low-modulus thermoplastic polyurethane and having a layer thickness of 0.001 inch may be machine washable and machine dryable. Furthermore, such a composite material 104 is stain resistant and capable of grading at level five (5) when tested according to the American Association of Textile Chemists and Colorists (AATCC) test 130-2015 for stain release using blood. Sewn seams of such a composite material 104 may exhibit relatively high strength. For example, corner seams between adjacent side portions 114A-144D may exhibit a minimum bursting strength of at least 106 psi when tested according to ASTM Test Method D3786/D3786M-13, while the seams between the top portion 112 and the side portions 114A-114D may exhibit a minimum bursting strength of at least 49 psi when tested according to ASTM Test Method D1683/D1683M-11. Such a composite material 104 is non-pilling and grades at a class five (5) when tested according to ASTM Test Method D3512/3512M-10 (2014). Furthermore, such a composite material 104 exhibits good durability and may require a minimum of 1,863 cycles or more to reach the backer, and a minimum of 4,148 cycles or more to reach a hole when tested according to ASTM Test Method D3389-15.

Furthermore, the stretchability of the composite material 104 allows embodiments of the mattress protector 100 as illustrated in FIGS. 5 through 7 to fit mattresses 102 having relatively thick dimensions (e.g., up to 18 inches thick or more), even when the side portions 114A-114D include the composite material 104. Mattress protectors as described herein also may be sized and configured to cover mattress toppers (also referred to as mattress "overlays"), in addition to mattresses themselves.

Although embodiments of mattress protectors 100 as described herein may be employed with any style of mattress, they are particularly advantageous when used with modern mattresses employing advanced mattress technology, such as those including elastomeric buckling column walls, memory foam, latex, and air-bladders, which tend to be highly distortable and more conforming to the body of a user.

For example, in some embodiments, a mattress cover 100 as described herein may be employed in conjunction with mattresses that include an elastomeric polymer cushion including buckling walls defining columnar voids extending within the mattress. Examples of such mattresses are disclosed in, for example, U.S. Pat. No. 5,749,111 issued May 12, 1998 to Pearce, U.S. Pat. No. 6,026,527 issued Feb. 22, 2000 to Pearce, U.S. Pat. No. 6,413,458 issued Jul. 2, 2002 to Pearce, U.S. Pat. No. 8,919,750 issued Dec. 30, 2014 to Pearce et al., the disclosure of each of which is incorporated herein in its entirety by this reference.

Figure 8:
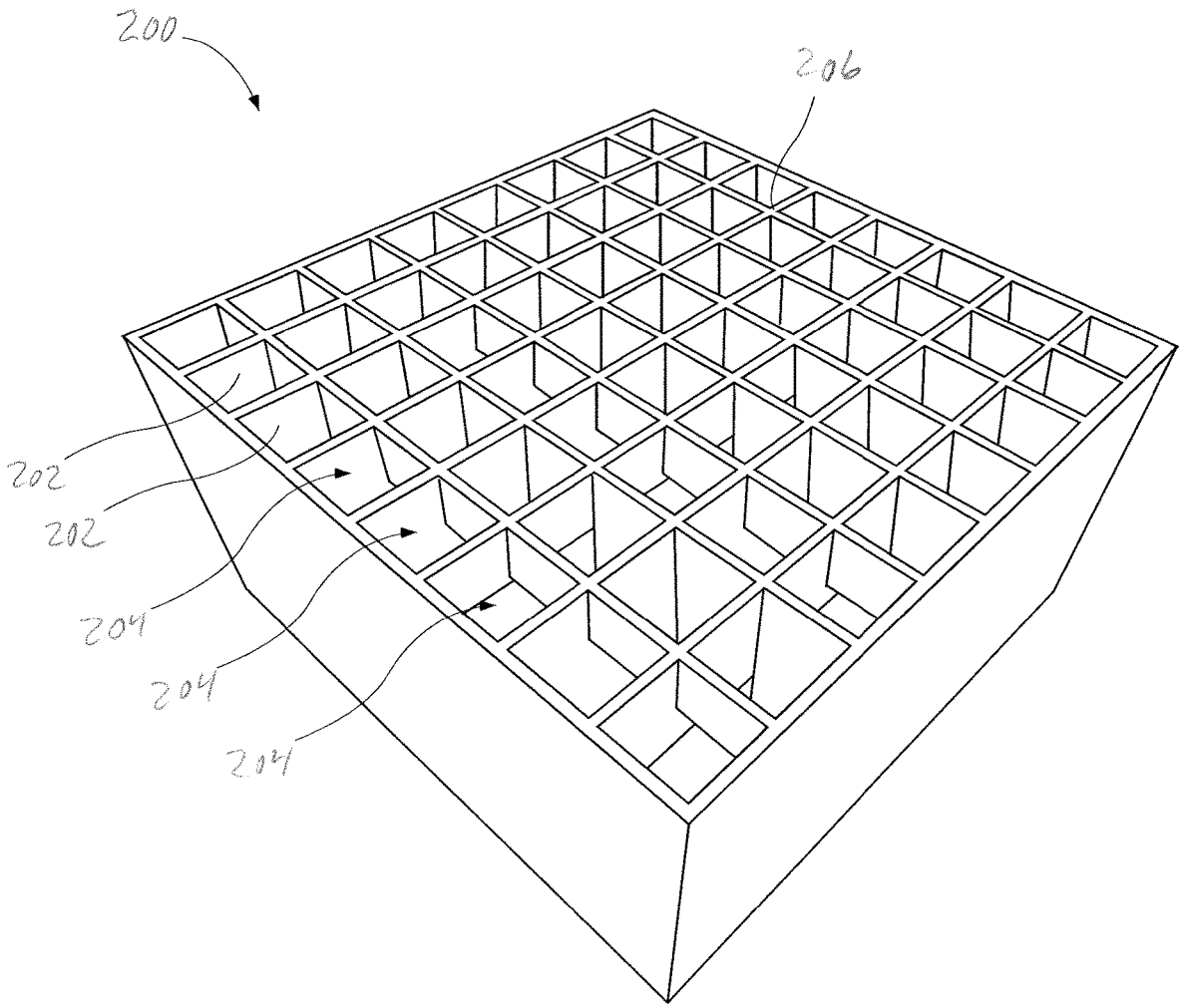
FIG. 8 is a simplified and schematically illustrated drawing of a portion of a mattress cushion that may be employed in a mattress together with mattress protectors as disclosed herein.

FIG. 8 illustrates a portion of an example of such an elastomeric polymer cushion 200. The elastomeric polymer cushion 200 has buckling walls 202 defining columnar voids 204 extending within the cushion 200 generally along a direction perpendicular to a cushioning surface 206 of the elastomeric polymer cushion 200. The buckling walls 202 are configured to buckle when a force applied to the cushioning surface 206 exceeds a threshold level.

As used herein, the term "elastomeric polymer" means and includes a polymer capable of recovering its original size and shape after deformation. In other words, an elastomeric polymer is a polymer having elastic or viscoelastic properties. Elastomeric polymers may also be referred to as "elastomers" in the art. Elastomeric polymers include, without limitation, homopolymers (polymers having a single chemical unit repeated) and copolymers (polymers having two or more chemical units).

As used herein, the term "elastomeric block copolymer" means and includes an elastomeric polymer having groups or blocks of homopolymers linked together, such as A-B diblock copolymers and A-B-A triblock copolymers. A-B diblock copolymers have two distinct blocks of homopolymers. A-B-A triblock copolymers have two blocks of a single homopolymer (A) each linked to a single block of a different homopolymer (B).

As used herein, the term "plasticizer" means and includes a substance added to another material (e.g., an elastomeric polymer) to increase a workability of the material. For example, a plasticizer may increase the flexibility, softness, or extensibility of the material. Plasticizers include, without limitation, hydrocarbon fluids, such as mineral oils. Hydrocarbon plasticizers may be aromatic or aliphatic.

As used herein, the term "elastomeric material" means and includes elastomeric polymers and mixtures of elastomeric polymers with plasticizers and/or other materials. Elastomeric materials are elastic (i.e., capable of recovering size and shape after deformation). Elastomeric materials include, without limitation, materials referred to in the art as "elastomer gels," "gelatinous elastomers," or simply "gels."

With continued reference to FIG. 8, the buckling walls 202 of cushion 200 are interconnected to one another and part of a single, integral volume of elastomeric material. As shown in FIG. 8, the buckling walls 202 may be oriented in two directions, intersecting at right angles, and defining square voids 204 (see FIG. 1B). However, the buckling walls 202 may intersect one another at any angle. For example, the buckling walls 202 may intersect at other angles and define voids 204 of other shapes, such as triangles, parallelograms, hexagons, etc.

The buckling walls 202 are formed of an elastomeric material. Elastomeric materials are described in, for example, U.S. Pat. No. 5,994,450, issued Nov. 30, 1999, and entitled "Gelatinous Elastomer and Methods of Making and Using the Same and Articles Made Therefrom"; U.S. Pat. No. 7,964,664, issued Jun. 21, 2011, and entitled "Gel with Wide Distribution of MW in Mid-Block"; and U.S. Pat. No. 4,369,284, issued Jan. 18, 1983, and entitled "Thermoplastic Elastomer Gelatinous Compositions"; the disclosures of each of which are incorporated herein in their entirety by this reference. The elastomeric material may include an elastomeric polymer and a plasticizer. The elastomeric material may be a gelatinous elastomer (also referred to in the art as gel, elastomer gel, or elastomeric gel), a thermoplastic elastomer, a natural rubber, a synthetic elastomer, a blend of natural and synthetic elastomers, etc.

The elastomeric polymer may be an A-B-A triblock copolymer such as styrene ethylene propylene styrene (SEPS), styrene ethylene butylene styrene (SEBS), and styrene ethylene ethylene propylene styrene (SEEPS). For example, A-B-A triblock copolymers are currently commercially available from Kuraray America, Inc., of Houston, Tex., under the trade name SEPTON® 4055, and from Kraton Polymers, LLC, of Houston, Tex., under the trade names KRATON® E1830, KRATON® G1650, and KRATON® G1651. In these examples, the "A" blocks are styrene. The "B" block may be rubber (e.g., butadiene, isoprene, etc.) or hydrogenated rubber (e.g., ethylene/propylene or ethylene/butylene or ethylene/ethylene/propylene) capable of being plasticized with mineral oil or other hydrocarbon fluids. The elastomeric material may include elastomeric polymers other than styrene-based copolymers, such as non-styrenic elastomeric polymers that are thermoplastic in nature or that can be solvated by plasticizers or that are multi-component thermoset elastomers.

The elastomeric material may include one or more plasticizers, such as hydrocarbon fluids. For example, elastomeric materials may include aromatic-free food-grade white paraffinic mineral oils, such as those sold by Sonneborn, Inc., of Mahwah, N.J., under the trade names BLANDOL® and CARNATION®.

In some embodiments, the elastomeric material may have a plasticizer-to-polymer ratio from about 0.1:1 to about 50:1 by weight. For example, elastomeric materials may have plasticizer-to-polymer ratios from about 1:1 to about 30:1 by weight, or even from about 1.5:1 to about 10:1 by weight. In further embodiments, elastomeric materials may have plasticizer-to-polymer ratios of about 2:1 by weight.

The elastomeric material may include any type of gelatinous elastomer. For example, the elastomeric material may include a melt-blend of one part by weight of a styrene-ethylene-ethylene-propylene-styrene (SEEPS) elastomeric triblock copolymer (e.g., SEPTON® 4055) with two parts by weight of a 70-weight straight-cut white paraffinic mineral oil (e.g., CARNATION® white mineral oil) and, optionally, pigments, antioxidants, and/or other additives.

The elastomeric material may comprise a material that returns to its original shape after deformation, and that may be elastically stretched. The elastomeric material may be rubbery in feel, but may deform to the shape of an object applying a deforming pressure better than conventional rubber materials, and may have a durometer hardness lower than conventional rubber materials. For example, the elastomeric material may have a hardness on the Shore A scale of less than about 50, from about 0.1 to about 50, or less than about 5.

The elastomeric material may be generally nonsticky, such that the cushion 200 may return to its original shape after a load is removed. That is, the elastomeric material may be sufficiently nonsticky so that buckling walls 202 do not stick to one another or do not remain stuck to one another after a deforming force is removed. Thus, any contact between adjacent buckling walls 202 may cease immediately or soon after the force is removed. The elastomeric material may be formulated to have any selected stickiness or tackiness, such as to control the rate of response to removal of a load.

The cushion 200 may be combined with other layers of material, such as foam, and encased in fabric so as to form a mattress 102.

Although the mattress protectors have been described herein as sized and configured for standard bed mattresses, addition embodiments of the present disclosure include protectors as described herein but shaped and dimensioned so as to cover other types of cushions, such as pillows, chair cushions, beds and cushions for pets, etc.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. In addition, features from one embodiment may be combined with features of another embodiment while still being encompassed within the scope of the disclosure as contemplated. Further, embodiments of the disclosure have utility with different and various types and configurations of mattresses and other cushions.

What is claimed is:

1. A mattress protector, comprising:

a single continuous composite sheet having a non-deformed length and a non-deformed width, the composite sheet including:

a fabric with between 4% to 15% by weight elastomeric fibers; and a water impermeable polymer carried by the fabric with a greatest average layer of thickness of 0.0015, wherein the fabric is embedded within a layer of the water impermeable polymer;

wherein the composite sheet is capable of repeatedly stretching to a deformed length of at least 115% of the non-deformed length and returning to within 8% of the non-deformed length without rupture or permanent wrinkling of the composite sheet.

2. The mattress protector of claim 1, wherein the composite sheet is capable of repeatedly stretching to the deformed length of at least 115% of the non-deformed length and returning to within 8% of the non-deformed length without rupture or permanent wrinkling of the composite sheet responsive to a tensile force less than six pounds per linear inch.

3. The mattress protector of claim 2, wherein the composite sheet is capable of repeatedly stretching to a deformed length of at least 125% of the non-deformed length and returning to within 8% of the non-deformed length without rupture or permanent wrinkling of the composite sheet responsive to a tensile force less than five pounds per linear inch.

4. The mattress protector of claim 1, wherein the fabric comprises a knitted fabric.

5. The mattress protector of claim 4, wherein the knitted fabric comprises between about 10% and about 20% by weight spandex.

6. The mattress protector of claim 5, wherein the knitted fabric comprises between about 80% and about 90% by weight polyester.

7. The mattress protector of claim 6, wherein the knitted fabric comprises knitted yarn.

8. The mattress protector of claim 1, wherein the mattress protector includes a rectangular top portion and four rectangular side portions, opposing side ends of each rectangular side portion adjoined to side ends of two adjacent rectangular side portions, at least the top portion comprising the composite sheet.

9. The mattress protector of claim 1, further comprising an elastic member extending along a lower end of each of the four rectangular side portions.

10. The mattress protector of claim 1, wherein the mattress protector has the shape of a rectangular prism when disposed on a mattress and includes a rectangular top portion, a rectangular bottom portion, and four rectangular side portions, at least the rectangular top portion comprising the composite sheet.

11. The mattress protector of claim 10, further comprising an openable and closable aperture through which a mattress may be inserted into the mattress protector.

12. The mattress protector of claim 11, further comprising a fastening member for fastening the aperture closed.

13. The mattress protector of claim 12, wherein the fastening member comprises a zipper.

14. An assembly, comprising:

a mattress; and a mattress protector covering at least one surface of the mattress, the mattress protector comprising a single continuous composite sheet having a non-deformed length and a non-deformed width, the composite sheet including:

a fabric with between 4% to 15% by weight elastomeric fibers; and a water impermeable polymer carried by the fabric wherein the impermeable polymer is disposed primarily to one side of the fabric wherein the fabric is partially exposed on one side thereof;

wherein the composite sheet is capable of repeatedly stretching to a deformed length of at least 115% of the non-deformed length and returning to within 8% of the non-deformed length without rupture or permanent wrinkling of the composite sheet.

15. The assembly of claim 14, wherein the fabric comprises a knitted fabric, the knitted fabric comprising yarn including between about 10% and about 20% by weight spandex.

16. The assembly of claim 15, wherein the mattress comprises an elastomeric polymer cushion, the elastomeric polymer cushion including buckling walls defining columnar voids extending within the mattress generally along a direction perpendicular to a cushioning surface of the elastomeric polymer cushion, the buckling walls configured to buckle when a force applied to the cushioning surface exceeds a threshold level.

17. A method of forming a mattress protector, comprising:

providing a fabric;

providing a water impermeable polymer on the fabric, the fabric comprising between 4% to 15% by weight elastomeric fibers; embedded the fabric within a layer of the water impermeable polymer; and forming a single continuous composite sheet having a non-deformed length and a non-deformed width, wherein the composite sheet is formulated and configured so as to be capable of repeatedly stretching to a deformed length of at least 115% of the non-deformed length and returning to within 8% of the non-deformed length without rupture or permanent wrinkling of the composite sheet.

18. The method of claim 17, wherein providing the fabric comprises providing a knitted fabric.

19. The method of claim 18, wherein providing the knitted fabric comprises providing a knitted fabric including between about 10% and about 20% by weight spandex.

20. The method of claim 19, wherein providing the knitted fabric further comprises providing a knitted fabric comprising between about 80% and about 90% by weight polyester.

* * * * *